US010344961B2

(12) United States Patent
Li

(10) Patent No.: US 10,344,961 B2
(45) Date of Patent: Jul. 9, 2019

(54) OPTICAL APPARATUS

(71) Applicant: LEEDARSON AMERICA INC., Smyrna, GA (US)

(72) Inventor: Yongchuan Li, Smyrna, GA (US)

(73) Assignee: LEEDARSON AMERICA INC., Smyrna, GA (US)

( * ) Notice: Subject to any disclaimer, the term of this patent is extended or adjusted under 35 U.S.C. 154(b) by 0 days.

(21) Appl. No.: 15/680,115

(22) Filed: Aug. 17, 2017

(65) Prior Publication Data

US 2019/0056097 A1 Feb. 21, 2019

(51) Int. Cl.

| | |
|---|---|
| ***F21K 99/00*** | (2016.01) |
| ***F21V 29/508*** | (2015.01) |
| ***F21K 9/233*** | (2016.01) |
| ***F21V 5/00*** | (2018.01) |
| ***F21K 9/237*** | (2016.01) |
| ***F21K 9/235*** | (2016.01) |
| ***F21K 9/238*** | (2016.01) |
| ***F21V 29/89*** | (2015.01) |
| ***F21V 29/74*** | (2015.01) |
| *F21Y 115/10* | (2016.01) |

(52) U.S. Cl.

CPC ..... *F21V 29/508* (2015.01); *F21K 9/233* (2016.08); *F21K 9/235* (2016.08); *F21K 9/237* (2016.08); *F21K 9/238* (2016.08); *F21V 5/004* (2013.01); *F21V 29/74* (2015.01); *F21V 29/89* (2015.01); *F21Y 2115/10* (2016.08)

(58) Field of Classification Search

CPC ..... F21K 9/235; F21K 9/237

USPC ..... 362/234, 311.02, 520, 522, 311.04, 326, 362/330, 334, 335, 336, 338

See application file for complete search history.

(56) References Cited

U.S. PATENT DOCUMENTS

| | | | | |
|---|---|---|---|---|
| 3,425,056 | A * | 1/1969 | Dawson | F21V 5/00 340/815.76 |
| 7,441,929 | B2 * | 10/2008 | Stefanov | F21K 9/00 362/336 |
| 7,448,783 | B2 * | 11/2008 | Ohkawa | F21V 5/04 257/E33.073 |
| 2003/0156417 | A1 * | 8/2003 | Gasquet | F21V 5/04 362/329 |
| 2005/0152153 | A1 * | 7/2005 | Amano | F21V 5/04 362/520 |
| 2014/0247604 | A1 * | 9/2014 | Tang | G02B 19/0028 362/311.02 |
| 2015/0354780 | A1 * | 12/2015 | Wang | G02B 3/08 362/294 |
| 2015/0369450 | A1 * | 12/2015 | Johnson | G02B 3/08 362/294 |
| 2018/0038557 | A1 * | 2/2018 | Klafta | F21K 9/237 |

* cited by examiner

*Primary Examiner* — Laura K Tso
(74) *Attorney, Agent, or Firm* — Chun-Ming Shih

(57) ABSTRACT

An optical apparatus has a LED plate, a lens plate, a cup body, a driver plate and two metal pins. The lens plate has a central lens and a plurality of micro optical structures. The cup body has a dome portion, a tube portion and a bottom portion. The dome portion and the tube portion are manufactured together as a single body. A portion of light emitting from the LED plate runs through the central lens of the lens plate to form a focus light beam and another portion of light emitting from the LED modules running through the plurality of micro optical structures to form soft light. Two input terminals of the driver plate are inserted into the two metal pins.

14 Claims, 8 Drawing Sheets

OPTICAL APPARATUS

FIELD OF INVENTION

The present invention is related to an optical apparatus and more particularly related to an optical apparatus with LED modules.

BACKGROUND

Optical device is widely used in human daily life. For example, various optical devices are designed for providing illumination. Some optical devices provide special light effect for required function.

For example, spotlight devices are used for generating a focus light to particularly placing light beam on a desired object like a painting or a dinner table. Even for the same spotlight function, different parameters may provide different light effects.

Therefore, it would be a technical challenge to design a simple structure of spotlight device and would be even better if heat dissipation and assembling factors are also considered in such design. Particularly, if flexibility is also provided, it would be even more beneficial.

SUMMARY OF INVENTION

According to a first embodiment of the present invention, a LED apparatus has a LED plate, a lens plate, a cup body and a driver plate.

The LED plate has a plurality of LED modules. The lens plate has a central lens, a surrounding lens and a peripheral lens. The surrounding lens surrounds the central lens. The peripheral lens surrounds the peripheral lens. The LED modules are located below the central lens for the central lens to generate the focus light beam. The surrounding lens and the peripheral lens are used for generating two light effects not the same as the focus light beam. The central lens, the surrounding lens and the peripheral lens are made of a single body with plastic material.

The cup body has a dome portion, a tube portion and a bottom portion. The dome portion and the tube portion are manufactured together as a single body with the plastic material. The lens plate is fixed to a top peripheral end of the dome portion of the cup body. The LED plate is disposed inside the dome portion.

The driver plate contains driver circuits, two output terminals and two input terminals.

Two metal pins are integrated to the bottom portion of the cup body. The two input terminals of the driver plate are connected with the two metal pins and the two output terminals connected to the LED plate.

In a specific example, the optical apparatus may further include a metal cup. The LED plate is placed upon a surface of the metal cup for heat dissipation.

In a specific example, the optical apparatus may further include a metal dome. The metal dome is placed inside and adjacent to the dome portion of the cup body.

In a specific example, the dome portion of the cup body may have a plurality of transparent rib lens on an exterior surface of the dome portion. Such design may help heat dissipation and also improve appearance of the overall optical apparatus.

In a specific example, the optical apparatus may further include a metal cup. The LED plate is placed upon a surface of the metal cup for heat dissipation. In addition, the metal cup and the metal dome are formed together as a single body.

In a specific example, the optical apparatus may further include a metal tube. The metal tube is placed inside and adjacent to the tube portion of the cup body for performing heat dissipation of the driver plate.

In a specific example, the central lens is composed of a plurality of micro lens. The plurality of micro lens are arranged to form the focus beam together.

In addition, the plurality of micro lens may be disposed at an inner side of the lens plate facing to the LED plate. In other words, the protrusion surface is facing to the LED modules instead of exposing outside in such design option.

In a specific example, the surrounding lens is composed of a plurality of polygonal lens. For example, such polygonal lens helps light diffusion so as to provide a better overall light effect of the optical apparatus.

In a specific example, the peripheral lens is composed of a plurality of rib lens being arranged adjacent to each other. Such rib lens may help collecting light emitting to the peripheral area to increase overall light efficiency.

In a specific example, the central lens, the surrounding lens and the peripheral lens may be made of Polycarbonate material. In addition, the cup body may also be made of Polycarbonate material. Such design helps further down cost the overall optical apparatus and simplify manufacturing complexity.

In a specific example, the two metal pins are molded with the bottom portion of the cup body. For example, when the cup body is to be molded in a molding device, the metal pins are placed in the molding device so that when the molding of the cup body is completed, the metal pins are integrated with the cup body immediately. This helps simplify manufacturing process and also helps more reliably fix the metal pins with the cup body.

In a specific example, the two input terminals of the driver plate are inserted into the two metal pins respectively. For example, the two metal pins have holes and the input terminals are plugged into the holes of the metal pins.

In a specific example, the LED plate has two connectors have elastic force to fix the output terminals of the driver plate when the output terminals of the driver are plugged into the two connectors. For example, the two connectors may be designed as clips or springs.

In a specific example, the lens plate is replaceable with another lens plate with different focus beam characteristic. For example, screw grooves or clips are provided at the connection portion of the lens plate and the cup body so that users may change different lens plate with different focus beam characteristic by themselves. This is very helpful to increase value of such optical apparatus, because users may buy one such optical apparatus set and use the apparatus for different needs or scenarios.

Specifically, a detachable connection structure like screws or clips may be designed so that users may change a different lens plate to fit their needs. For example, a user may buy such spotlight apparatus with a number of lens plates with different central lens settings. The user may replace the default lens plate with another lens plate, e.g. to emit a wider light beam or a narrower light beam. In addition, different colors of lens plate may be designed so that users may change a different color filter to affect the light beam from such spotlight apparatus.

In a specific example, there is a neck portion between the dome portion and the tube portion. There is a first distance between where the LED plate is disposed and the neck portion. There is a second distance between the top peripheral and the neck portion. The first distance is smaller than half of the second distance and larger than one fourth of the second distance.

In another example, the LED plate is placed at the neck portion.

In another specific example, there are diffusion optical structures formed on the dome portion and the tube portion, e.g. to increase overall light output and to prevent visual exposing of the components of the spotlight apparatus.

In another specific example, the two metal pins have openings respectively for receiving the two input terminals of the driver plate. In other words, the two input terminals may not need to be welded but are just plugged into the metal pins. This helps significant decrease manufacturing cost.

In another specific example, the two metal pins are metal hollow tubes. For example, the two metal pins are cylinder shape with central opening.

In another specific example, a portion of the input terminals of the driver plate is deformed when the input terminals are inserted into the openings of the two metal pins to keep better connection between the input terminals and the two metal pins. The input terminal may be made with elastic metal so that when the input terminals are plugged into the metal pins, the input terminals have form changing and increasing a force to fix to the metal pins.

In another specific example, the two metal pins are molded with the bottom portion of the cup body. For example, the metal pins are not connected to the bottom portion of the cup body by screw structures. Instead, the metal pins are placed in a molding device while molding the bottom portion of the cup body.

In a specific example, the dome portion, the tube portion and the bottom portion of the cup body are together formed with Polycarbonate (PC) material as a single body. Please note that other plastic or material may be adopted if they allow light to go through.

In another specific example, the two metal pins are inserted in a molding device when the molding device is used for produce the cup body so that the two metal pins are molded with the bottom portion of the cup body.

In a specific example, the lens plate is made of Polycarbonate material as a single body. In other words, the cup body and the lens plate may be made of same PC material thus making the overall cost even lower.

In a specific example, the tube portion of the cup body has a track trench for guiding and inserting the driver plate. With such design, the driver plate may be reliably fixed to the tube portion of the cup body.

In a specific example, the driver plate has a base plate with metal material for heat dissipation. For example, the base plate may be made of aluminum.

To further increase heat dissipation, heat dissipation gel may be applied between the track trench and the driver plate to enhance heat dissipation.

Alternatively, heat dissipation glue may be applied between the track trench and the driver plate to enhance heat dissipation and connection reliability between the track trench and the driver plate.

In a specific example, the lens plate has a transparent hollow cup facing the LED modules.

In an example, the optical apparatus may further have a metal dome, the metal dome being placed inside and adjacent to the dome portion of the cup body. The bottom of the metal dome may have a peripheral area connecting to the metal cup for help heat dissipation.

In another example, a plurality of protrusion structures are arranged regularly on an exterior surface of the dome portion of the cup body. For example, the protrusion structures form associated of lens facing to the corresponding metal dome inside the dome portion. With such design, heat dissipation is further achieved while the metal cup has better appearance.

In another example, the bottom surface of the metal cup has at least one through hole and the output terminals go through the through hole to connect to the LED plate. The metal cup may have several parts with one part connecting to the LED plate and another part connecting to the driver plate to perform heat dissipation from different sources. In the LED apparatus, the driver plate and the LED plate are two major heat sources that needs heat dissipation.

In another example, the bottom surface of the metal cup has at least one through hole and the driver plate goes through the through hole to electrically connected to the LED plate.

In another example, the central lens of the lens plate has a plurality of micro optical structures for forming a focus light beam by guiding optical path of the LED plate. Compared with one single lens, such micro optical structure may prevent uncomfortable light effect when people stare at the LED apparatus.

In a specific example, the plurality of micro optical structures are formed in a back side facing to the LED plate. Furthermore, a top side of the central lens opposite to the back side of the central lens has a smooth surface without protrusion structure. In other words, the top surface of the LED apparatus exposed outside may be well protected without damaging the lens during movement or installation. Besides, it would be easier to clean the surface of the LED apparatus.

In a specific example, the LED modules are placed under the central lens.

In a specific example, the dome portion has a detachable structure for replacing the lens plate to another lens plate to change light beam effect of the lens plate.

DETAILED DESCRIPTION

Figure 1:
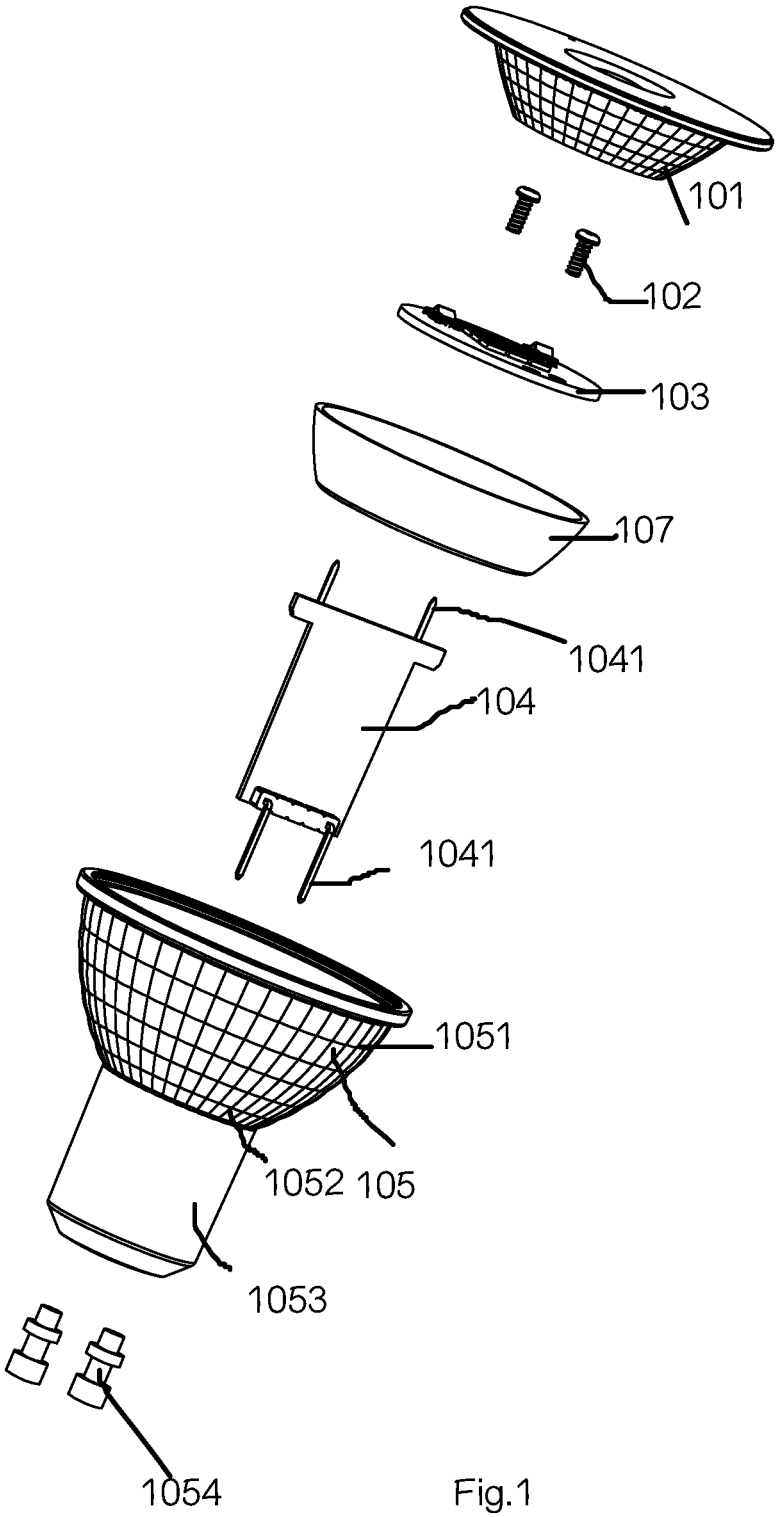
FIG. 1 illustrates an exploded diagram of components of a LED apparatus embodiment according to the present invention.
Figure 5:
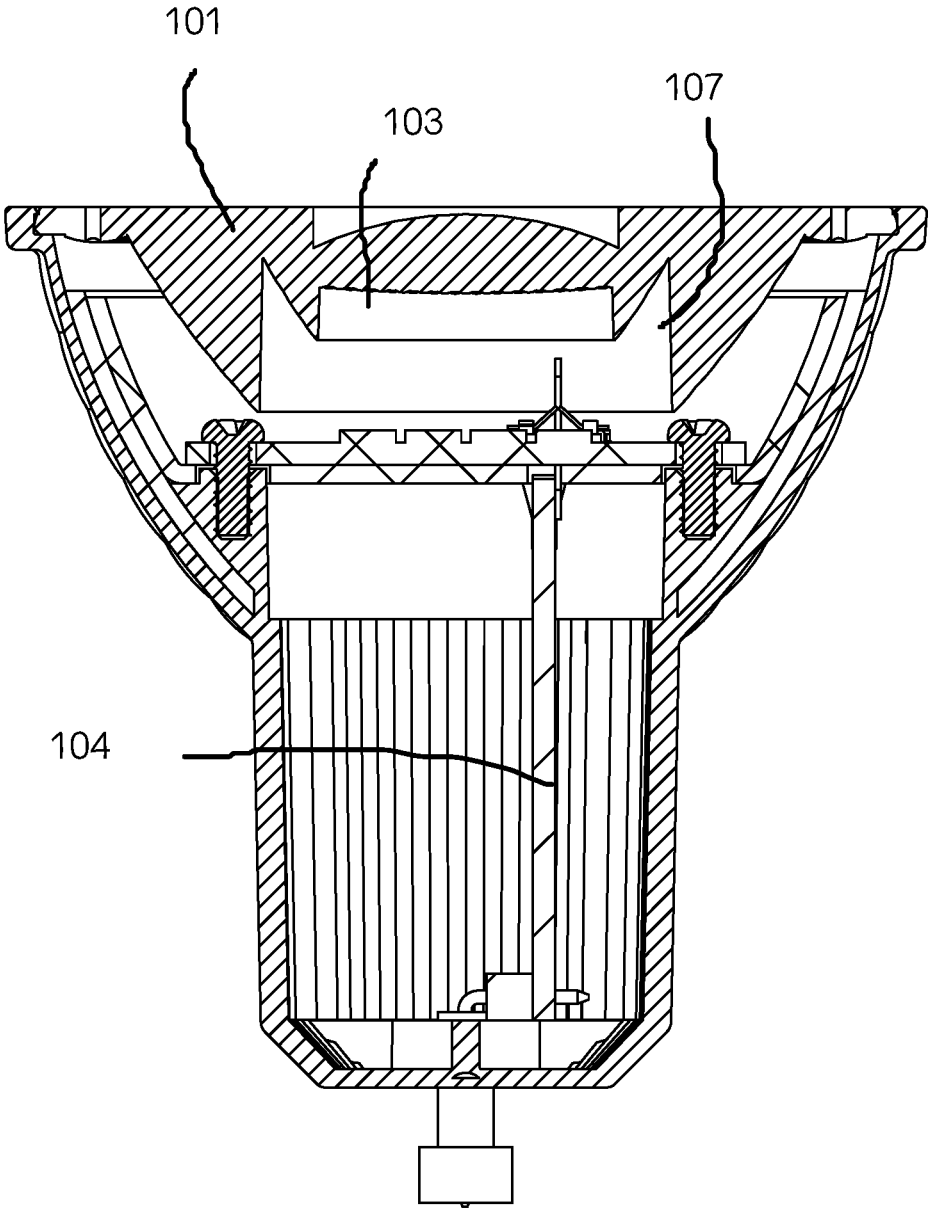
FIG. 5 is a side view of the spot light embodiment of FIG. 1 when the spotlight is assembled.

Please refer to FIG. 1 and FIG. 5. FIG. 1 illustrates an exploded diagram of components of an optical apparatus. FIG. 5 illustrates a side view of cross-sectional diagram of the components of FIG. 1 when they are assembled together.

The spotlight apparatus has a LED plate 103, a lens plate 101, a cup body 105, a driver plate 104, a pair of screws 102 for fixing the components.

The LED plate 103 has a plurality of LED modules, a metal plate and two connectors. The plurality of LED modules and the two connectors are mounted on the metal plate. The LED modules may each be a single LED chip or multiple LED chips formed as a module.

Figure 2A:
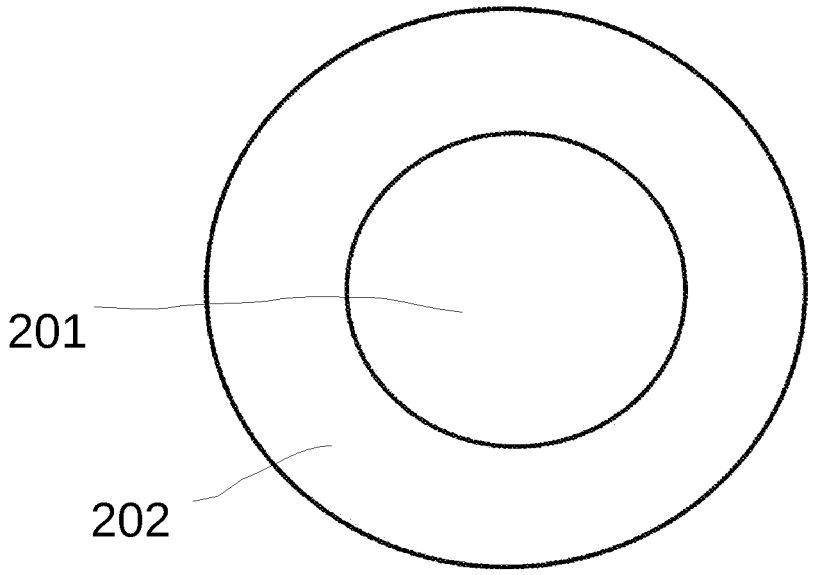
FIG. 2A illustrates an embodiment of a lens plate.
Figure 2B:
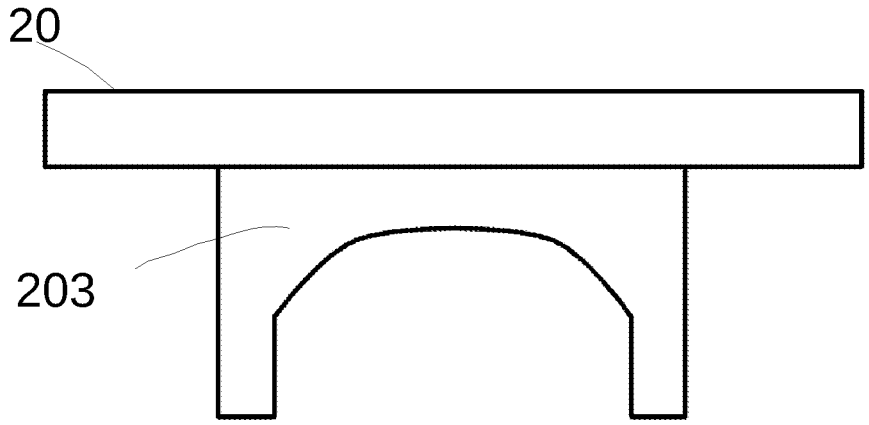
FIG. 2B illustrates side view of FIG. 2A.

Please refer to FIG. 2A and FIG. 2B, which illustrate a lens plate example. In FIG. 2A and FIG. 2B, the lens plate is a circular shape and has a central lens 201 and a plurality of micro optical structures 202 around the central lens. Micro optical structures are patterns including concave or other structure that may guide or change light paths to achieve certain optical effect. FIG. 2B is a side view of FIG. 2A. The lens plate 20 has a transparent hollow cup 203 structure for guiding light entering the central lens 201. The central lens 201 may be made of a single lens or multiple lens that generates the effect of creating a spotlight beam.

Different lens plate may be prepared for generating spotlight apparatuses with different light beam characteristics while the other components kept unchanged.

Therefore, a detachable connection structure like screw or clips may be designed so that users may change a different lens plate to fit their needs. For example, a user may buy such spotlight apparatus with a number of lens plates with different central lens settings. The user may replace the default lens plate with another lens plate, e.g. to emit a more wide light beam or a narrower light beam. In addition, different colors of lens plate may be designed so that users may change a different color filter to affect the light beam from such spotlight apparatus.

Please refer back to FIG. 1. The cup body 105 has a dome portion 1051, a tube portion 1053 and a bottom portion, which facing to and integrated with two metal pins 1054. The dome portion 1051 and the tube portion 1053 are manufactured together as a single body. The lens plate 101 is fixed to a top peripheral end of the dome portion 1051 of the cup body 105. The LED plate 103 is disposed inside the dome portion 1051 so that a portion of light emitting from the LED modules running through the central lens of the lens plate 101 to form a focus light beam and another portion of light emitting from the LED modules running through the plurality of micro optical structures to form soft light. The plurality of micro optical structures may be designed to diffuse the light or made of tiny cave, blocks or dots. The central lens may also be made of multiple lens structures instead of a single lens.

In addition, a metal cup 107 is used for mounting the LED plate 103. A bottom surface of the metal cup is attached to the back side of the LED plate for heat dissipation for heat generated by the LED plate. The metal cup 107 has peripheral portion for increasing heat dissipation area. Fins or other structures may also be applied to design the metal cup 107. Furthermore, the peripheral portion of the metal cup 107 may be designed to engage with the dome portion 1051 of the cup body to increase heat dissipation effect.

The driver plate 104 contains driver circuits, two output terminals and two input terminals.

The two metal pins 1054 are integrated to the bottom portion of the cup body 105. The two input terminals 1041 of the driver plate 104 are inserted into the two metal pins 1054 and the two output terminals 1042 connected to the LED plate 103.

In a specific example, there is a neck portion 1052 between the dome portion and the tube portion.

Figure 3:
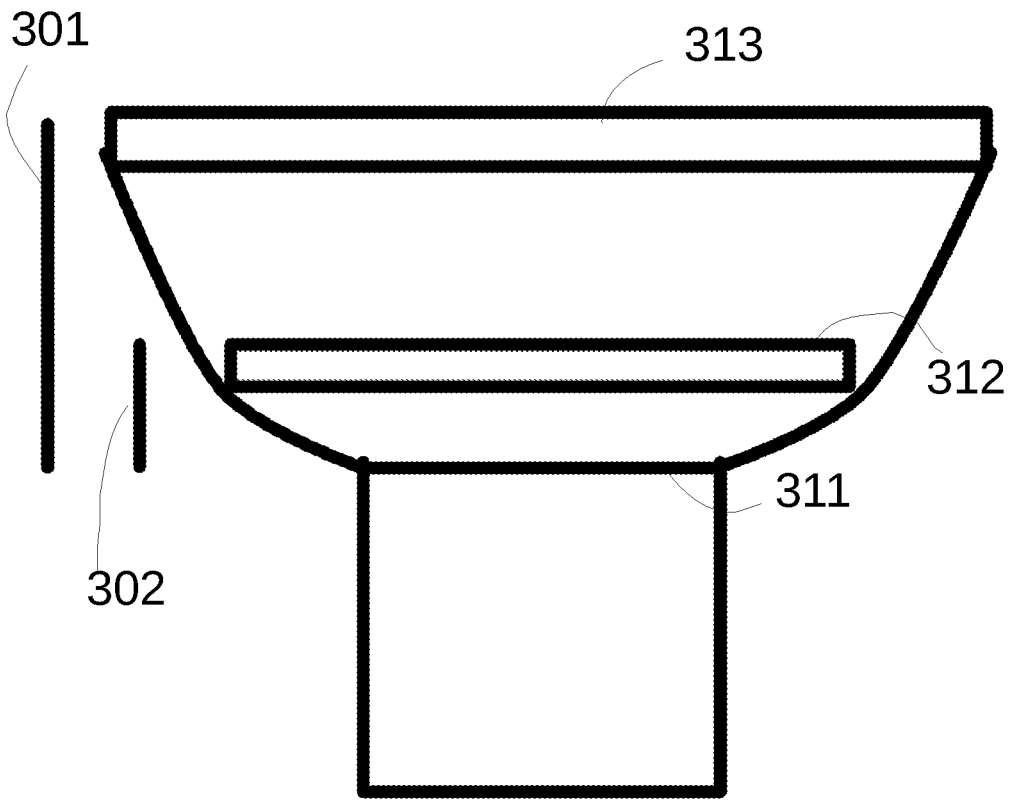
FIG. 3 illustrates a cup body embodiment.

Please also refer to FIG. 3. There is a first distance 302 between where the LED plate 312 is disposed and the neck portion 311. There is a second distance 301 between the top peripheral 313 and the neck portion 311. The first distance 302 is smaller than half of the second distance 301 and larger than one fourth of the second distance 301. For example, the first distance 302 is about ⅓ of the second distance 301. Such arrangement makes both light efficiency and heat dissipation for leaving space for heat movement.

In another specific example, there are diffusion optical structures formed on the dome portion and the tube portion, e.g. to increase overall light output and to prevent visual exposing of the components of the spotlight apparatus.

In another specific example, the two metal pins have openings respectively for receiving the two input terminals of the driver plate. In other words, the two input terminals may not need to be welded but just plugged into the metal pins. This helps significant decrease manufacturing cost.

In another specific example, the two metal pins are metal hollow tubes. For example, the two metal pins are cylinder shape with central opening.

In another specific example, a portion of the input terminals of the driver plate is deformed when the input terminals are inserted into the openings of the two metal pins to keep better connection between the input terminals and the two metal pins. The input terminal may be made with elastic metal so that when the input terminals are plugged into the metal pins, the input terminals has form changing and increasing force to fix to the metal pins.

In another specific example, the two metal pins are molded with the bottom portion of the cup body. For example, the metals are not connected to the bottom portion of the cup body by screw structures. Instead, the metal pins are placed in a molding device while molding the bottom portion of the cup body.

In a specific example, the dome portion, the tube portion and the bottom portion of the cup body are together formed with Polycarbonate (PC) material as a single body. Please note that other plastic or material may be adopted if they allow light to go through.

Figure 4:
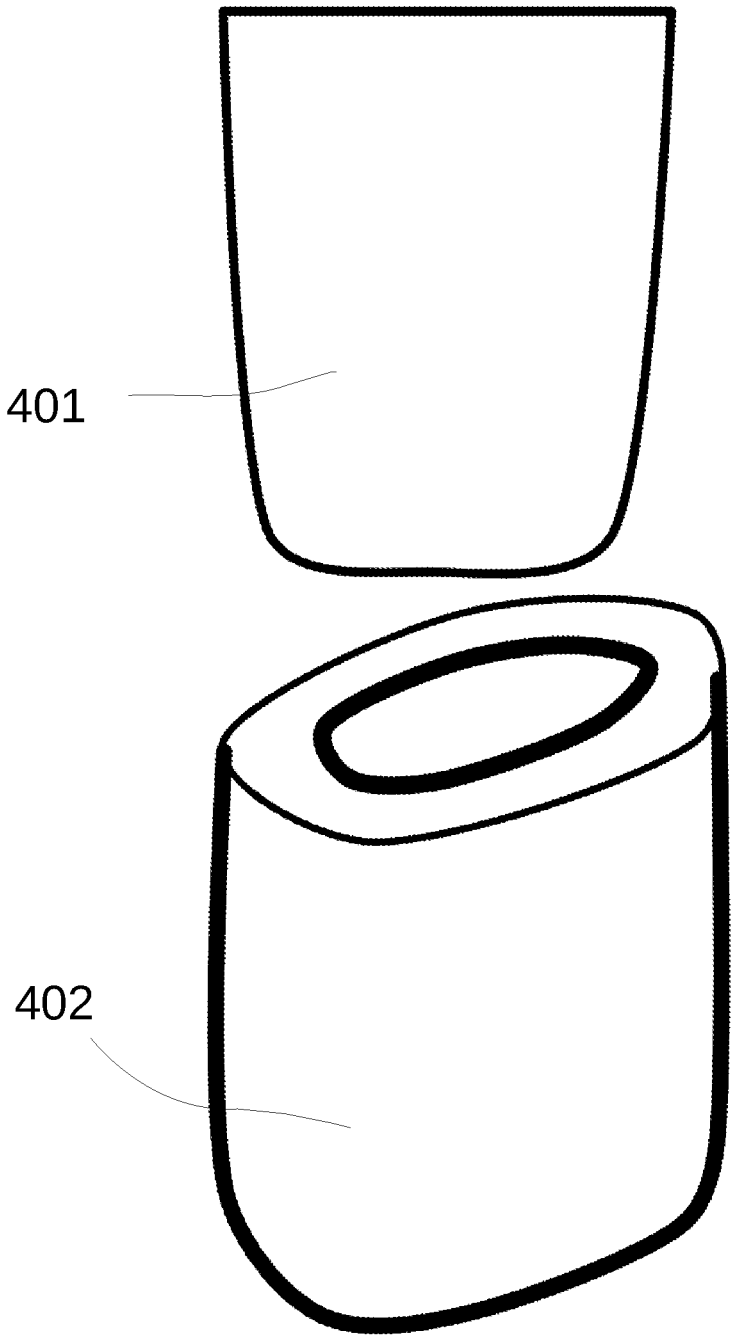
FIG. 4 illustrates a diagram of metal pins and input terminals.

Please refer to FIG. 4, which illustrates interaction between an input terminal of a driver plate 401 and a metal pins 402. The front end of the input terminal is inserted into a hole of the metal pins 402. In addition, a deformation of the inserted portion of the input terminal 401 would help fixing better for the input terminal 401 and the metal pins 402. In another specific example, the two metal pins are inserted in a molding device when the molding device is used for produce the cup body so that the two metal pins are molded with the bottom portion of the cup body.

In a specific example, the lens plate is made of Polycarbonate material as a single body. In other words, the cup body and the lens plate may be made of same PC material thus making the overall cost even lower.

In a specific example, the tube portion of the cup body has a track trench for guiding and inserting the driver plate. With such design, the driver plate may be reliably fixed to the tube portion of the cup body.

In a specific example, the driver plate has a base plate with metal material for heat dissipation. For example, the base plate may be made of aluminum.

To further increase heat dissipation, heat dissipation gel may be applied between the track trench and the driver plate to enhance heat dissipation.

Alternatively, heat dissipation glue may be applied between the track trench and the driver plate to enhance heat dissipation and connection reliability between the track trench and the driver plate.

In a specific example, the lens plate has a transparent hollow cup facing the LED modules.

Figure 6:
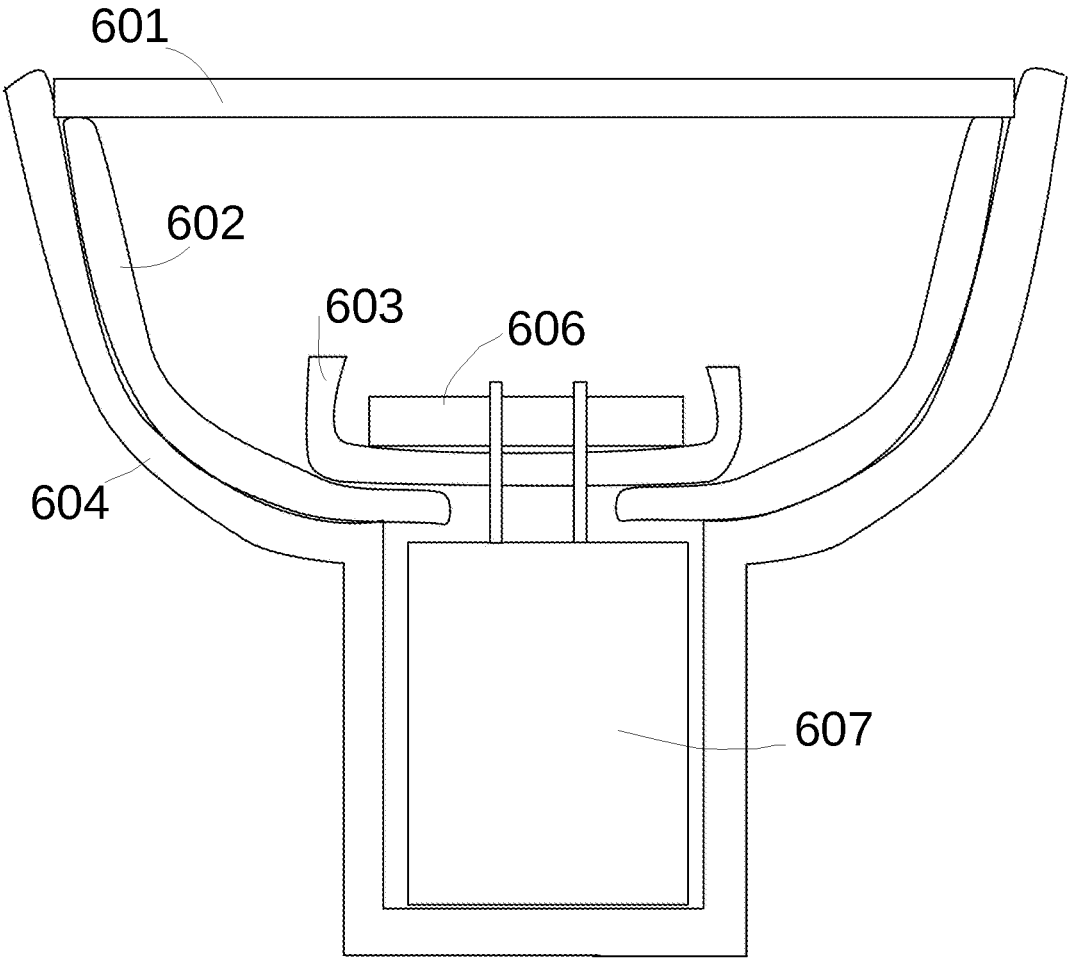
FIG. 6 illustrates another embodiment with a metal dome.

Please refer to FIG. 6, which illustrates a cross sectional view of another embodiment. In FIG. 6, the LED apparatus has a lens plate 601, a cup body 604, a driver plate 607, a metal cup 603 and a LED plate 606. In addition, the LED apparatus further has a metal dome 602. The metal dome 602 is placed inside and adjacent to the dome portion of the cup body 604. A bottom portion of the metal dome 604 may contact with the metal cup 603 for helping carrying heat to the dome portion of the cup body 604. The metal dome 602 may have a dome shape similar to the dome portion of the cup body 604 so that these two components may contact to each other to perform heat dissipation.

Figure 7A:
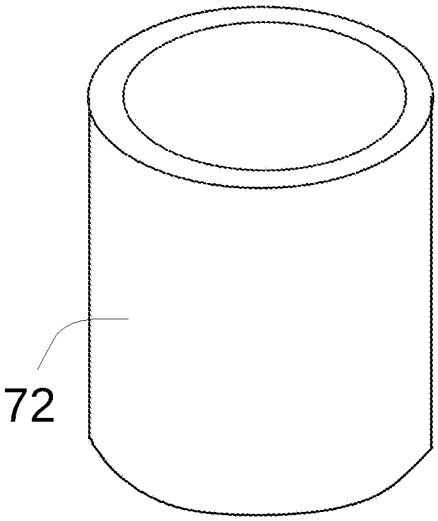
FIG. 7A, FIG. 7B and FIG. 7C illustrate another embodiment with a metal tube.
Figure 7B:
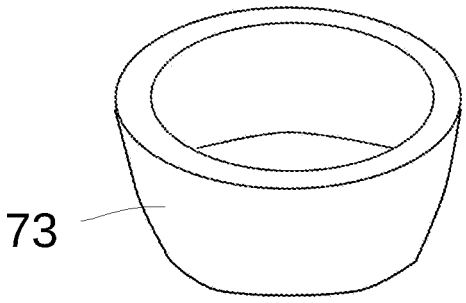
Figure 7C:
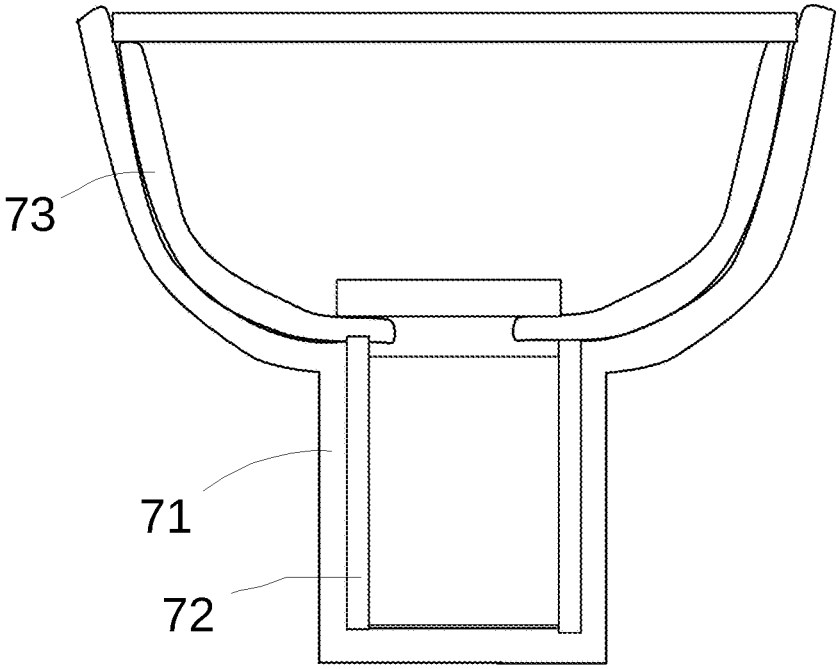

Please refer to FIG. 7A, FIG. 7B and FIG. 7C, which illustrate another embodiment with a metal tube 72 inside and adjacent to the tube portion of the cup body 71. Please also note that in this embodiment, the metal cup and the metal dome 73 are formed together as a single body. The metal tube 73 may also be made together with the metal dome to form a single body.

Figure 8:
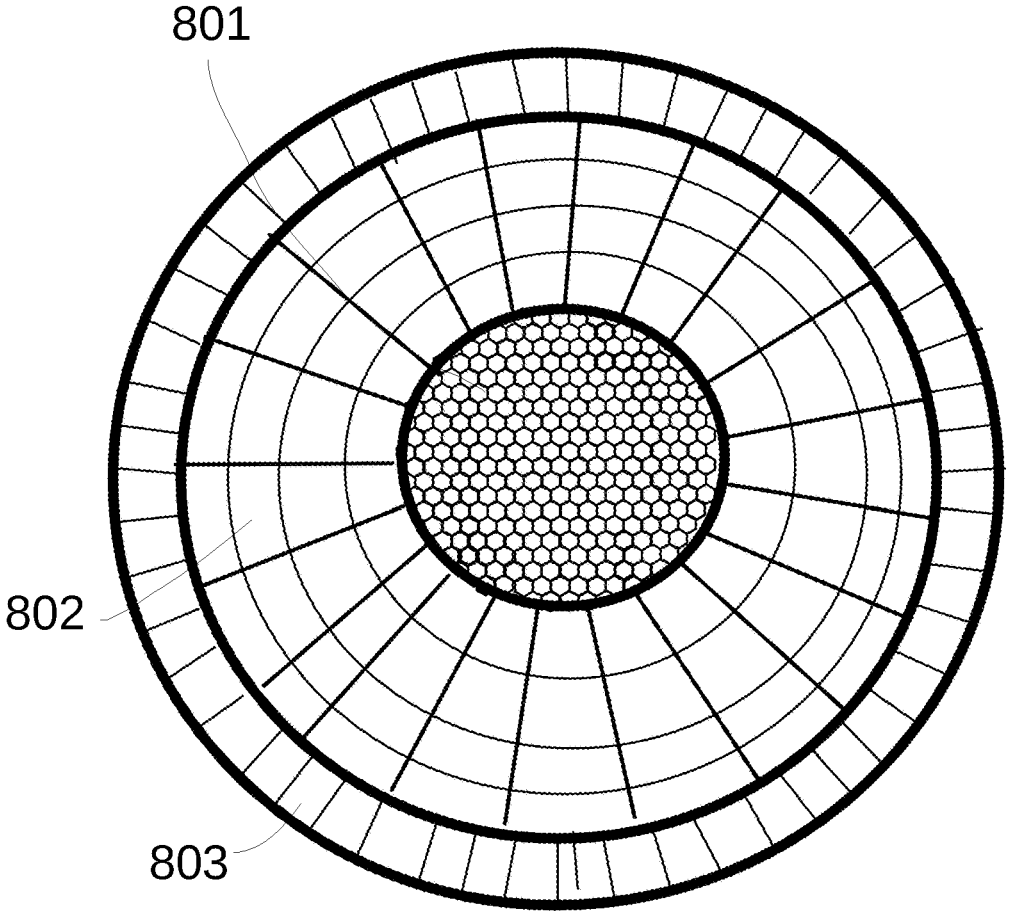
FIG. 8 illustrates an embodiment of central lens, surrounding lens and peripheral lens structure.

Please refer to FIG. 8, which illustrate an embodiment of lens plate. In this embodiment, the central lens 801 is surrounded by a surrounding lens 802. The surrounding lens 802 is further surrounded by a peripheral lens 803. The central lens 801 has a plurality of micro lens for together forming a focus beam while the surrounding lens 802 and the peripheral lens 803 are used for generating other light effect like light diffusion. In this example, the surrounding lens 802 has a plurality of polygonal lens and the peripheral lens 803 has a plurality of rib lens.

Rib lens refer to an elongated lens for guiding light direction to a desired effect. Such rib lens may also be disposed outside or inside the tube portion of the cup body to gain better heat dissipation or visual appearance.

The embodiments mentioned above should not be interpreted as limitation for the present invention. Persons of ordinary skilled in the art would be able to create equivalent designs under protection scopes.

The invention claimed is:

1. An optical device for forming a focus beam, comprising:

a LED plate comprising a plurality of LED modules;

a lens plate, comprising a central lens, a surrounding lens and a peripheral lens, the surrounding lens surrounding the central lens, the peripheral lens surrounding the surrounding lens, the LED modules being located below the central lens for the central lens to generate the focus light beam, the surrounding lens and the peripheral lens for generating two light effects not the same as the focus light beam, the central lens, the surrounding lens and the peripheral lens being made of a single body with plastic material;

a cup body, the cup body comprising a dome portion, a tube portion and a bottom portion, the dome portion and the tube portion being manufactured together as a single body with plastic material, the lens plate being fixed to a top peripheral end of the dome portion of the cup body, the LED plate being disposed inside the dome portion;

a driver plate containing driver circuits, two output terminals and two input terminals; and two metal pins integrated to the bottom portion of the cup body, the two input terminals of the driver plate connected with the two metal pins and the two output terminals connected to the LED plate.

2. The optical apparatus of claim 1, further comprising a metal cup, the LED plate is placed upon a surface of the metal cup for heat dissipation.

3. The optical apparatus of claim 1, further comprising a metal dome, the metal dome being placed inside and adjacent to the dome portion of the cup body.

4. The optical apparatus of claim 1, further comprising a metal cup, the LED plate is placed upon a surface of the metal cup for heat dissipation, the metal cup and the metal dome are formed together as a single body.

5. The optical apparatus of claim 1, further comprising a metal tube, the metal tube being placed inside and adjacent to the tube portion of the cup body for performing heat dissipation of the driver plate.

6. The optical apparatus of claim 1, where the central lens is composed of a plurality of micro lens, the plurality of micro lens are arranged to form the focus beam together.

7. The optical apparatus of claim 6, wherein the plurality of micro lens are disposed at an inner side of the lens plate facing to the LED plate.

8. The optical apparatus of claim 1, wherein the surrounding lens is composed of a plurality of polygonal lens.

9. The optical apparatus of claim 1, wherein the peripheral lens is composed of a plurality of rib lens being arranged adjacent to each other.

10. The optical apparatus of claim 1, wherein the central lens, the surrounding lens and the peripheral lens are made of Polycarbonate material.

11. The optical apparatus of claim 1, wherein the two metal pins are molded with the bottom portion of the cup body.

12. The optical apparatus of claim 1, wherein the two input terminals of the driver plate are inserted into the two metal pins respectively.

13. The optical apparatus of claim 1, wherein the LED plate has two connectors for receiving and clipping the two output terminals of the driver plate.

14. The optical apparatus of claim 1, wherein the lens plate is replaceable with another lens plate with different focus beam characteristic.

* * * * *